United States Patent [19]

Grossman et al.

[11] Patent Number: 4,661,078

[45] Date of Patent: Apr. 28, 1987

[54] METHODS FOR DISPENSING MERCURY INTO DEVICES

[75] Inventors: Mark W. Grossman, Belmont; William A. George, Rockport, both of Mass.

[73] Assignee: GTE Products Corporation, Danvers, Mass.

[21] Appl. No.: 816,557

[22] Filed: Dec. 31, 1985

[51] Int. Cl.[4] ..... H01J 9/38

[52] U.S. Cl. ..... 445/9; 204/105 R; 445/26

[58] Field of Search ..... 445/9, 26; 204/45.1, 204/105 R

[56] References Cited

U.S. PATENT DOCUMENTS

| | | | |
|---|---|---|---|
| 2,195,231 | 3/1940 | Weder | 204/45.1 X |
| 3,639,222 | 2/1972 | Scheiner et al. | 204/105 R X |
| 3,673,406 | 6/1972 | Nief et al. | 250/43 |
| 4,427,919 | 1/1984 | Grenfell | 445/9 X |
| 4,534,742 | 8/1985 | Grossman et al. | 445/9 |
| 4,539,508 | 9/1985 | Mulder et al. | 445/9 X |

OTHER PUBLICATIONS

*Photochemical Isotope Separation of Hg-196 by Reaction with Hydrogen Halides,* Webster, C. R. and Zare, R. N., J. Phy. Chem., 85, 1302–1305.

*Photochemical Enrichment of Hg-196,* Grossman, M., and Maya, J., XIII, Intern. Elec. Con. Tech. Dig., 139–140 (Jun. 18–21, 1984).

*Energy Conservation Through more Efficient Conservation,* Jaya, J., Grossman, M. W., Lagushenko, R., Waymouth, J., Science, 226, 435–436 (Oct. 26, 1984).

*Primary Examiner*—Kenneth J. Ramsey

*Attorney, Agent, or Firm*—Hamilton, Brook, Smith & Reynolds

[57] ABSTRACT

A process for dispensing mercury into devices which requires mercury. Mercury is first electrolytically separated from either HgO or $Hg_2Cl_2$ and plated onto a cathode wire. The cathode wire is then placed into a device requiring mercury.

19 Claims, 2 Drawing Figures

METHODS FOR DISPENSING MERCURY INTO DEVICES

GOVERNMENTS RIGHTS

The Government has rights in this invention pursuant to Subcontract 4524210 under Prime Contract DE-AC03-765F00098 awarded by the U.S. Department of Energy.

FIELD OF THE INVENTION

This invention is in the field of physics. More particularly, it relates to a method for obtaining and placing mercury into devices requiring mercury.

BACKGROUND OF THE INVENTION

Methods have been devised for dispensing mercury or other materials with high vapor pressure characteristics into a gas-filled discharge tube such as a fluorescent lamp. Typically, the mercury or a like material is inserted into a capsule or ampule and the capsule is then inserted into the envelope of the tube. At the desired moment during the manufacturing process, mercury is released by opening the ampule. See, for example, U.S. Pat. No. 3,684,345 and U.S. Pat. No. 4,534,742.

Recently it has been determined that the efficiency of low pressure mercury-rare gas discharge lamps can be enhanced if the isotopic mixture of the mercury is changed from that which occurs naturally. See, for example, Electric Discharge Lamps, MIT Press, 1971, by J. Waymouth for basic principles of low pressure mercury rare gas discharge lamps and U.S. Pat. No. 4,379,252. This patent teaches efficiency gains in fluorescent lamps when the $^{196}Hg$ isotope is increased from its natural occurrence of about 0.14% to about 3%.

The problem of employing such altered compounds of mercury lies in their expense. For example, at current prices, mercury which has been enhanced to contain 35% of the $^{196}Hg$ isotope costs about $500/milligram (mg). Accordingly, it can be seen that the use of this material requires very strict controls on the amount employed. Further, such materials need only be used in milligram or submilligram amounts. It has been very difficult to dispense such precise and accurate amounts of Hg into devices which require mercury. It is particularly difficult when the amount of mercury required is in milligram or submilligram amounts.

SUMMARY OF THE INVENTION

This invention comprises a method for dispensing precise and accurate quantities of Hg into devices which require mercury.

In one embodiment, mercury is electrolytically separated from $Hg_2Cl_2$ in an electrolyte solution comprising a mixture of concentrated HCl and $H_2O$. The mercury-plated cathode is then removed and placed into the device which requires mercury.

In a second embodiment, mercury is separated from HgO. The electrolyte solution employed in this embodiment is a mixture of glacial acetic acid and $H_2O$. After the reduction of mercury ions is completed, the mercury-plated cathode is removed and placed into a device requiring mercury.

This invention also comprises a method for placing a mercury-plated cathode wires into a capsule or ampule. The ampule is then placed into the fluorescent lamp; the ampule is then opened and mercury is vaporized, thus, being released into the lamp.

DETAILED DESCRIPTION OF THE INVENTION

This invention comprises a method for dispensing mercury into devices which require mercury. In particular, it discloses a method for electrolytically depositing Hg onto a cathode from solution of $Hg_2Cl_2$ or HgO. The mercury plated cathode is then placed directly into a device which requires mercury.

In one embodiment, Hg is dispensed into a device which requires Hg by first electrolytically plating Hg from $Hg_2Cl_2$ onto a cathode wire. The electrolyte solution used contains concentrated HCl and $H_2O$. In a preferred embodiment, the solution is in the relative molar concentration of 1 mole of HCl/57 moles of $H_2O \pm 20\%$. Mercurous ions are placed into solution by dissolving $Hg_2Cl_2$ into the electrolyte solution. A precise amount of $Hg_2Cl_2$ may be added to obtain a precise amount of mercury onto the cathode. Also, different isotopic types of $Hg_2Cl_2$ may be added to the electrolyte solution to obtain a predetermined isotopic distribution of Hg on the cathode wire. In another embodiment, $Hg_2Cl_2$ is added to the electrolyte solution until the solution is saturated.

An inert wire such as platinum can be used as the anode and the wire to be plated with Hg is used as the cathode. The cathode wire can be purified copper, nickel or Niron. (Niron is a trademark for a magnetic alloy composed of about 50% nickel and 50% iron manufactured by Amax Corporation of Orangeburg, S.C.). An electric voltage of 0.9 or higher (as determined by the I-V characteristic of the system) is applied across the anode and the cathode. The electric voltage creates an electric current which runs from the anode through the electrolyte solution to the cathode. Voltages below 1.3 produce good results for unsaturated solutions of $Hg_2Cl_2$ for the types of wire cathode mentioned above. The electric current reduces the mercurous ions in solution and plates them onto the cathode. The mercury-plated cathode is then removed from the electrolyte and placed directly into the device requiring mercury. The electrolyte solution is kept at a temperature of about 25° C. and the solution is stirred during the plating process to promote the dissociation of $Hg_2Cl_2$.

Figure 1:
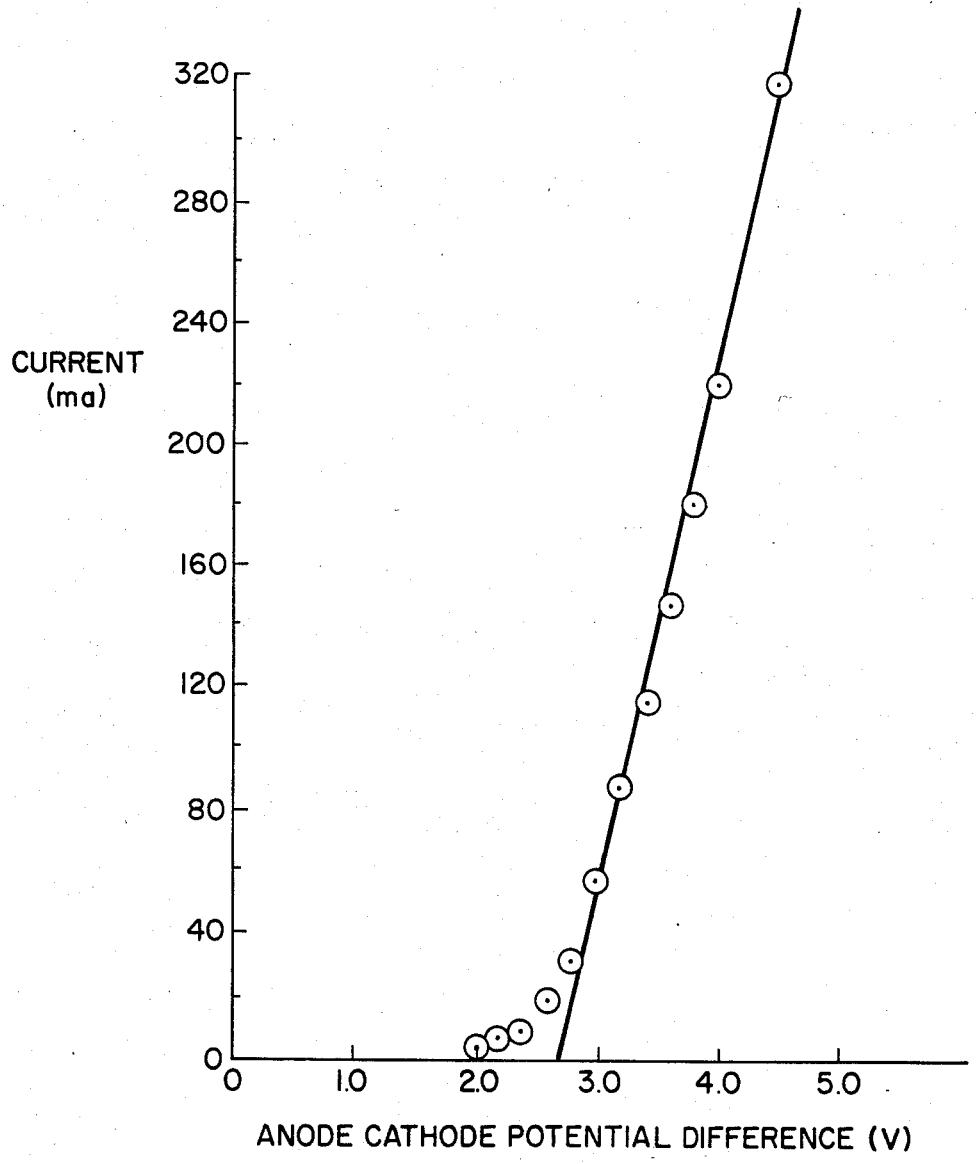
FIG. 1 is a decomposition curve for a dilute HCl solution with excess $Hg_2Cl_2$.

To determine the ideal voltage which should be applied to the electrolyte solution for successful plating, the I-V or decomposition characteristic of the system must be determined. This is determined by plotting the current as a function of voltage as illustrated in FIG. 1. This graph shows two distinct phases. The initial phase depicts a climb in current as a high enough voltage is reached so as to allow the Hg ions to begin to be reduced.

At 0.9 volts, mercurous ions start to be reduced. As the voltage is further increased, the current climbs very slowly indicating substantial Hg ion reduction. However, when the voltage reaches a certain point, called the breakdown voltage, the current rises sharply indicating that other chemical reactions are occurring at significant rates. The excess voltage causes these additional chemical reactions to occur.

Impurities are produced when the breakdown voltage level is reached. This is due to the electrolyte breakdown which occurs as a consequence of the additional chemical reactions which take place when the breakdown voltage is reached. The fact that the breakdown voltage has been reached can be determined by the fact that there is a steep increase in the current. The ammeter serves as a process parameter check rather than a direct measure of Hg plating rate due to the fact that it indicates an increase in current caused by these additional chemical reactions.

Electrolyte decomposition is a particular problem during the electrolytic recovery of Hg from $Hg_2Cl_2$, and electrolyte breakdown or separation can be severe when the electrolyte solution is not saturated with $Hg_2Cl_2$. Under saturated solution conditions, high voltage plating gives relatively pure Hg samples. When plating takes place under the unsaturated condition, the plated material is black and porous (possibly $Hg_2O$) and the solution becomes green (possibly mercury perchlorate being formed) unless care is taken to operate below the breakdown voltage.

Most of the decomposition current is due to decomposition of the electrolyte rather than Hg ion reduction. For $Hg_2Cl_2$, even though higher voltages could yield higher deposition rates, it also results in substances other than mercury being plated, so a compromise between plating rate and electrolyte breakdown must be found. The specific value being determined by the I-V characteristics of the system.

A similar curve results when current is plotted as a function of voltage during the electrolyte reduction of mercuric ions dissociated from HgO in a solution of glacial acetic acid and $H_2O$. However, electrolyte decomposition is not a significant problem during the electrolyte reduction of mercuric ions dissociated from HgO in an electrolyte solution of glacial acetic acid and water. The reduction of mercuric ions obtained from HgO is usually run at 50 ma for milligram and submilligram amounts of HgO. Voltages as high as 17 volts can be used to obtain this amperage resulting in very little electrolyte decomposition.

As mentioned above, from the decomposition curve, it can be determined at what voltage the Hg ions start to be reduced and where the breakdown voltage lies. The voltage between where the Hg ions begin to be reduced and the breakdown voltage lies in the I-V characteristics of the system. It is within this voltage range that optimal plating of Hg is obtained.

In another embodiment, Hg is dispensed into a device which requires mercury by first electrolytically obtaining Hg from HgO. For the separation of Hg from HgO, an inert wire such as platinum can also be used as the anode and the wire to be plated with Hg is used as the cathode. A purified nickel or copper wire can be used as the cathode. In electrolytically recovering Hg from HgO, the electrolyte solution used is a mixture of glacial acetic acid and $H_2O$. In a preferred embodiment, the solution is in the relative molar concentration of 1 mole of glacial acetic acid to 66 moles of $H_2O \pm 20\%$.

HgO is dissolved into the electrolyte solution An electric voltage (the maximum specific value being determined by the I-V characteristic of the system) is then applied to the anode and the cathode creating an electric current from the anode through the electrolyte solution to the cathode, whereby mercuric ions are reduced and elemental mercury plates onto the cathode wire.

Due to the fact that relatively high voltage is required to produce electrolyte decomposition during the reduction of mercuric ions from HgO in glacial acetic acid, very little attention is paid to voltage. Instead of voltage, amperage is the parameter which is most carefully monitored to promote the most rapid and complete reduction and plating of mercuric ions. At 50 ma using a cathode which is 2.5 cm long and 0.05 cm in diameter, made of either copper or nickel and a 2.5 cm long 0.05 cm diameter platinum wire as the cathode, one obtains rapid and complete reduction and plating of mercuric ions from HgO in glacial acetic acid and $H_2O$. 50 ma is reached by applying about 17 volts across the anode and the cathode.

The electrolyte solution is kept at a temperature of about 25° C. and stirred to promote the dissociation of HgO. After completion of the reduction of the mercury ions, the mercury-plated cathode is then removed and placed into a device which requires mercury.

The electrolyte separation is continued until the reduction of Hg ions is completed. By a complete reduction, it is meant that 90–99% of the Hg ions which can theoretically plate onto the cathode has plated onto the cathode. For milligram and submilligram amounts of Hg, it usually takes 4–5 hours for the electrolyte separation and reduction to be completed.

A precise amount of mercury can be plated onto the cathode and placed into a lamp by placing into the solution a precise amount of HgO which corresponds to the amount of HgO or $Hg_2Cl_2$ desired. Also, mercury with a predetermined isotopic distribution can be plated onto the cathode and placed into a lamp by placing into the solution different isotopic types of HgO or $Hg_2Cl_2$ the combination of which produces, upon reduction, Hg with the isotopic distribution desired. By a predetermined, arbitrary isotopic distribution of Hg, it is meant that the isotopic distribution of Hg obtained was intentionally chosen and was not a result of a random or natural occurrence resulting in the isotopic distribution obtained.

The plating process is non-linear in that the plating current depends on the concentration of species. This results in an observed exponential fall off of current versus time for fixed voltage. However, by knowing the initial conditions, e.g., initial electrolyte concentration, and the initial quantity of Hg compound, reproducible plating has been observed for milligram or submilligram quantities of Hg. The analysis of reproducibility was carried out by first plating Hg from a known initial mass of HgO and then utilizing inductively coupled plasma atomic absorption spectroscopy to determine the remaining Hg in solution. The point at which the reduction of Hg was completed was also determined by a potentiometric titration technique. For a detailed discussion of this potentiometric titration technique, see Overman, R. F. *Potentiometric Titration of Mercury Using the Iodide Selective Electrode as Indicator*, Anal. Chem. 43 No. 4,616–617 (April 1971) the teachings of which are herein incorporated by reference.

The invention is further illustrated by the following examples.

EXAMPLE 1

Plating of a Submilligram Quantity of HgO

Materials Used 2.5 cm long 0.05 cm diameter nickel wire cathode
2.5 cm long 0.05 cm diameter platinum wire anode
Glacial acetic acid
$H_2O$
3.56 mg HgO 3.56 mg of HgO were dissolved in 100 ml of glacial acetic acid and water. The solution was in the relative molar concentration of 1 mole of glacial acetic acid/66 moles of $H_2O$. 10 ml of this solution were removed. The 10 ml of solution contained 0.356 mg of HgO or 0.330 mg of mercuric ions. The platinum anode and the nickel cathode, connected to an appropriate power supply were placed into the 10 ml solution. The plating was carried out for 5.0 hours at 50 ma at a temperature of about 25° C.

After 5 hours, the plating was halted and a potentiometric titration was carried out on the remaining solution to determine the amount of Hg ions remaining in solution. It was determined that 0.0299 mg of Hg were in solution this represented a 91% yield of recovered Hg from the HgO.

EXAMPLE 2

Reduction of a Milligram Quantity of Mercury 1.02 mg $^{201}HgO$
2.5 cm long 0.05 cm diameter nickel wire cathode
2.5 cm long 0.05 cm diameter platinum wire anode
Glacial acetic acid
$H_2O$ 1.02 mg of $^{201}HgO$ was placed in solution of glacial acetic acid and water containing 19 parts of $H_2O$ for every part of glacial acetic acid. Plating was carried out for 5.5 hours at 50 ma using a 2.5 cm long 0.05 cm diameter nickel wire cathode. The remaining solution contained 0.013 mg of Hg which represents an approximate 99% recovery of Hg from the HgO.

EXAMPLE 3

Reduction of a Predetermined Amount of Mercury 2.0 mg of $^{201}HgO$
Distilled $H_2O$
Glacial Acetic Acid
2.5 cm long 0.05 cm diameter nickel wire cathode
2.5 cm long 0.05 cm diameter platinum wire anode 2.0 mg of $Hg^{201}$ ±10–15% were needed. 2.0 mg of $^{201}HgO$ were obtained and dissolved in 10 ml of glacial acetic acid and distilled $H_2O$ in the relative molar concentration of one mole of glacial acetic acid/66 moles of $H_2O$. Plating was carried out for 4 hours at 50 ma using a 2.5 cm long 0.05 cm diameter nickel wire cathode and a 2.5 cm long 0.05 cm diameter platinum wire anode.

Potentiometric titration of the remaining solution, after the plating was completed, indicated that $2\times10^{-2}$ mg of $Hg^{2+}$ ions remained in solution. This represented a 99% yield of Hg from HgO.

EXAMPLE 4

Reduction of a Larger Amount of Mercury 18.6 mg HgO
Glacial acetic acid
Distilled $H_2O$
20 cm long 0.05 cm diameter nickel wire cathode
20 cm long 0.05 cm diameter platinum wire anode To determine the percentage yield of the electrolyte separation of larger masses of mercury compounds, 18.6 mg of HgO were obtained. This HgO was then dissolved in 100 ml of glacial acetic acid and $H_2O$ in the relative molar concentration of one mole of glacial acetic acid/66 moles of $H_2O$. Plating was carried out for 4.6 hours at 250 ma. A 20 cm long 0.05 cm diameter nickel wire was used as the cathode and a 20 cm long 0.05 cm diameter platinum wire was the anode used.

Potentiometric titration of the remaining solution, after the plating was completed, indicated that 1.3 mg of $Hg^{2+}$ ions remained in the solution. This represented a 92% yield.

EXAMPLE 5

Preparation of Mercury with an Arbitrary Isotopic Distribution of Mercury

Materials Used
2.29 mg natural HgO
0.5 mg $^{204}HgO$
Glacial Acetic Acid
Water
2.5 cm long 0.05 cm diameter nickel wire cathode
2.5 cm long 0.05 cm diameter platinum wire anode It was desired to enrich 2.12 mg of mercury 6.84% of Hg 204 to mercury with a Hg 204 content of 14% . The amount of "HgO needed from 2.12 mg of "Hg was $$2.12 \text{ mg} \times \frac{200 \text{ mg}}{216 \text{ mg}} = 2.29 \text{ mg } ''\text{HgO}$$

The amount of $^{204}HgO$ needed to be mixed with 2.29 mg of "HgO to obtain the desired isotopic distribution was determined in the following way.

P=final fraction of desired isotope
X=amount of $^{204}Hg$ to be added to achieve P
C=initial $^{204}Hg$ concentration
I=initial total Hg weight
a=$^{204}Hg$ fraction in enriched HgO sample, which is 91.1% in this case.
d=(2.29) X/a=amount of $^{204}HgO$ sample to be added.

Then $$X = \frac{I(P - C)}{(1 - P)}$$

In this example $$X = \frac{(2.12)(0.140 - 0.068)}{1 - 0.14} = 0.711$$

$$d = (1.08)\frac{(0.177)}{0.9308} = 0.205 \text{ mg } ^{204}\text{HgO}$$

Thus, it was determined that 0.205 mg of $^{204}HgO$ having a 93.08% isotopic content of Hg 204 was needed to be mixed with 2.29 mg of natural Hg of electrolytically produce 2.12 mg of Hg having a Hg 204 content of 14%.

0.205 mg of $^{204}HgO$ and 2.29 mg of natural HgO were placed in a solution of glacial acetic acid and $H_2O$ having the relative molar concentration of 1 mole of glacial acetic acid to 66 moles of $H_2O$±20%. The platinum anode and the nickel cathode, connected to an appropriate power supply, were placed into the solution. Plating was carried at about 17 volts for 4.75 hours at 50 ma at about 25° C. Using potentiometric titration, it was determined that the remaining solution contained 0.0610 mg of mercuric ions. This represented a 97% yield of plated mercury.

The cathodes used in the separation of mercury from HgO and $Hg_2CL_2$ form Hg alloys having positive interaction enthalpies ($\Delta H > 0$). This implies that the plated Hg will tend to stay as free metal rather than chemically combine with these cathode materials.

Figure 2:
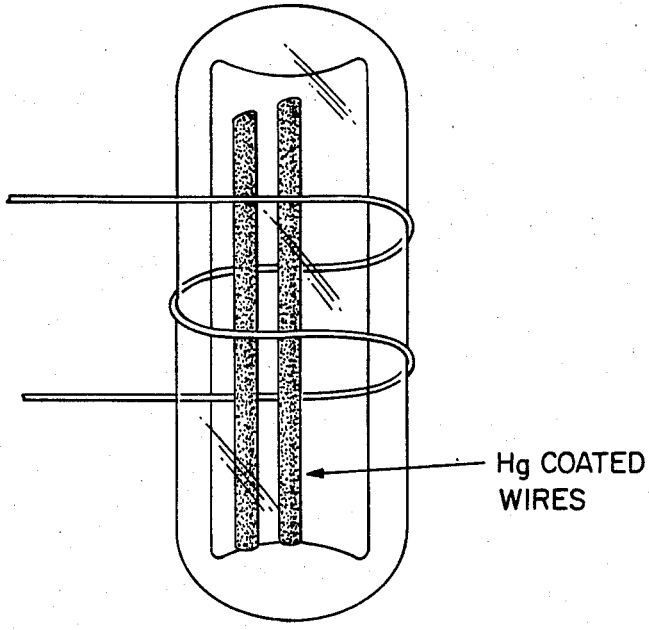
FIG. 2 depicts a glass capsule of the present invention in which a mercury plated cathode wire has been placed directly into the capsule.

The mercury plated cathode can then be placed into capsules made from infrared absorbing glass. In the present method, as shown in FIG. 2, mercury plated cathode wires are placed directly into capsules or ampules sealed at one end which are then evacuated and flame sealed. The sealed ampules can then be placed into the tube of a lamp. At the desired moment during the manufacturing process, the mercury is then released into the evelope of the lamps by opening the capsule.

A method for forming such capsules is disclosed in U.S. patent application Ser. No. 568,022, Grossman et al. filed Jan. 4, 1984. The teachings of which are hereby incorporated by reference.

A method and apparatus for dispensing small quantities of mercury from evacuated and sealed glass capsules are disclosed in U.S. Pat. No. 4,534,742. The teachings of which are hereby incorporated by reference.

The teachings disclosed in the above-mentioned patent, involves placing the evacuated and sealed glass capsule containing mercury into a discharge tube envelope. The capsule is radiated by two light sources simultaneously. The combination of the heat from the light source and the Hg vapor pressure inside the capsule causes the capsule to rupture and the vaporized mercury to diffuse throughout the envelope of the discharge tube.

See also U.S. Pat. No. 3,684,345, the teachings of which are hereby incorporated by reference, for the use of a heating coil for causing a softening and opening of the glass capsule.

INDUSTRIAL APPLICABILITY

The invention described herein relates to a method for dispensing mercury into devices which require mercury. Thus, it is applicable in the manufacturing of arc discharge lamps.

EQUIVALENTS

Those skilled in the art will recognize or be able to ascertain, using no more than routine experimentation many equivalents to the specific embodiments described herein. Such equivalents are to be covered by the following claims.

We claim:

1. A process for placing mercury into a device which requires mercury, comprising:

(a) dissolving HgO in an electrolyte solution, resulting in the dissociation of HgO and the formation of mercuric ions, said electrolyte solution comprising glacial acetic acid and $H_2O$;

(b) placing an anode and a cathode into the electrolyte solution;

(c) applying an electric voltage across the anode and the cathode, said electric voltage creating an electric current from the anode through the electrolyte solution to the cathode, whereby mercuric ions are reduced and elemental Hg is plated onto said cathode;

(d) continuing to apply the electric voltage to the anode and cathode until the mercuric ions are completely plated onto the cathode;

(e) removing the cathode; and (f) placing the mercury covered cathode into a device requiring mercury.

2. A process as recited in claim 1, wherein the electrolyte solution in step "a" is in the relative molar concentration of 1 mole of glacial acetic acid/66 moles of $H_2O \pm 20\%$.

3. A method as recited in claim 1, wherein the amount of HgO which is dissolved into the electrolyte solution is sufficient to obtain a predetermined milligram quantity of Hg.

4. A method as recited in claim 1, wherein the amount of HgO which is dissolved into the electrolyte solution is sufficient to obtain a predetermined submilligram quantity of Hg.

5. A method as recited in claim 1, wherein the cathode used in step "b" is a metal selected from the group consisting of purified copper and nickel.

6. A method as recited in claim 1, wherein the HgO used is an isotopic mixture which yields upon reduction a predetermined isotopic distribution of Hg.

7. A process a recited in claim 1, wherein the mercury-plated cathode of step "e" is placed into a lamp requiring mercury by:

(a) placing said cathode into a capsule, said capsule being opened at one end;

(b) evacuating said capsule;

(c) sealing the open end of the capsule;

(d) placing said capsule into a lamp envelope; and (e) opening said capsule, thus releasing said mercury into the lamp envelope by vaporizing said Hg.

8. A method for placing mercury having a specific isotopic content and mass into a lamp, which comprises:

(a) obtaining an amount of an isotopic mixture of HgO sufficient to produce a predetermined amount of Hg with a predetermined isotopic distribution through electrolyte reduction of said HgO;

(b) dissolving a plurality of isotopes of HgO in said electrolyte solution; said plurality of isotopes being sufficient to supply the quantity and type of mercuric ions necessary to produce upon electrolyte reduction and plating said elemental mercury with a pre-determined isotopic distribution;

(c) placing an anode and a cathode into said electrolyte solution, said cathode being a metal selected from the group consisting of purified copper and nickel;

(d) applying an electric voltage across said anode and cathode, the precise maximum voltage being determined by the I-V characteristic of the system, the electric voltage creating an electric current from the anode through the electrolyte solution to the cathode whereby Hg ions are reduced and elemental mercury is plated onto said cathode;

(e) continuing to apply said voltage across the anode and cathode until the reduction of mercuric ions is complete;

(f) removing the cathode; and (g) placing the mercury plated cathode into the lamp requiring mercury.

9. A process as recited in claim 8, wherein the mercury-plated cathode of step "f" is placed into a lamp requiring mercury by:

(a) placing said cathode into a capsule, said capsule being opened at one end;

(b) evacuating said capsule;

(c) sealing the open end of the capsule;

(d) placing said capsule into a lamp envelope; and (e) opening said capsule and releasing said mercury into the lamp envelope by vaporization.

10. A method for placing mercury into a device which requires mercury, which comprises:

(a) dissolving $Hg_2Cl_2$ in an electrolyte solution, resulting in the dissociation of $Hg_2Cl_2$ and the formation of mercurous ions, said electrolyte solution comprising a mixture of HCl and $H_2O$;

(b) placing an anode and a cathode into the electrolyte solution;

(c) applying an electric voltage across the anode and the cathode, said electric voltage creating an electric current from the anode through the electrolyte solution to the cathode whereby mercurous ions are reduced and elemental mercury plates onto the cathode;

(d) continuing to apply the electric voltage to the anode and cathode until the reduction of mercurous ions is complete;

(e) removing the mercury-plated cathode; and (f) placing said cathode in a device requiring mercury.

11. A method as recited in claim 10, wherein the electrolyte solution of step "a" comprising a mixture of concentrated HCl and $H_2O$ is in the relative molar concentration of 1 mole of HCl/57 moles of $H_2O \pm 20\%$.

12. A method as recited in claim 10, wherein the cathode of step "b" is a metal selected from the group consisting of purified nickel, copper and Niron.

13. A method as recited in claim 10, wherein the voltage applied in step "c" is at least 0.9 volts or higher as determined by the I-V characteristic of the system.

14. A method as recited in claim 10, wherein the amount of $Hg_2Cl_2$ used in step "a" is the amount required to produce a predetermined submilligram quantity of Hg.

15. A method as recited in Claim 10, wherein the amount of $Hg_2Cl_2$ used in step "a" is the amount required to produce a predetermined milligram quantity of Hg.

16. A method as recited in claim 10, wherein the $Hg_2Cl_2$ used is an isotopic mixture which yields upon reduction Hg with a predetermined isotopic content.

17. A process a recited in claim 10, wherein the mercury-plated cathode of step "f" is placed into a lamp requiring mercury by:

(a) placing said cathode into a capsule, said capsule being open at one end;

(b) evacuating said capsule;

(c) sealing the open end of the capsule;

(d) placing said capsule into a lamp envelope; and (e) opening said capsule and releasing said mercury into the envelope of the lamp by vaporization of said Hg.

18. A process for placing mercury having a specific isotopic content and mass, into a device, which comprises:

(a) obtaining a predetermined amount of an isotopic mixture of $Hg_2Cl_2$ which corresponds to a predetermined amount of Hg with a predetermined isotopic distribution that is to be reduced;

(b) dissolving a plurality of isotopes of $Hg_2Cl_2$ in said electrolyte solution; said plurality of isotopes being sufficient to supply the quantity and type of mercuric ions necessary to produce upon electrolyte reduction and plating said elemental mercury having a pre-determined isotopic distribution;

(c) placing an anode and a cathode into the electrolyte solution, said cathode being a metal selected from the group consisting of purified copper, nickel and Niron;

(d) applying an electric voltage across said anode and cathode, said electric voltage creating an electric current from the anode through the electrolyte solution to the cathode whereby mercurous ions are reduced and elemental mercury plates onto the cathode, said electric voltage being 0.9 volts or higher as determined by the I-V characteristic of the system;

(e) continuing to apply the electric voltage to the anode and the cathode until the reduction of mercurous ions is complete;

(f) removing said mercury-plated cathode; and (g) placing the cathode in a device which requires mercury.

19. A process as recited in claim 18, wherein the mercury-plated cathode of step "f" is placed into a lamp requiring mercury by:

(a) placing said cathode into a capsule, said capsule being open at one end;

(b) evacuating said capsule;

(c) sealing the open end of the capsule;

(d) placing said capsule into a lamp envelope; and (e) opening said capsule and releasing said mercury into the envelope of the lamp by vaporizing said mercury.

* * * * *